US008534669B2

(12) United States Patent
Ito et al.

(10) Patent No.: US 8,534,669 B2
(45) Date of Patent: Sep. 17, 2013

(54) CONVEYANCE DEVICE AND IMAGE FORMING DEVICE

(75) Inventors: Yoichi Ito, Tokyo (JP); Yuji Tanaka, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/344,787

(22) Filed: Jan. 6, 2012

(65) Prior Publication Data

US 2012/0187624 A1 Jul. 26, 2012

(30) Foreign Application Priority Data

Jan. 21, 2011 (JP) ..... 2011-011092

(51) Int. Cl.
*B65H 5/00* (2006.01)

(52) U.S. Cl.
USPC ..... 271/264; 271/108; 271/276

(58) Field of Classification Search
USPC ..... 271/108, 264, 276, 194
See application file for complete search history.

(56) References Cited

U.S. PATENT DOCUMENTS 6,371,430 B1 * 4/2002 Vernackt ..... 248/362
2010/0066781 A1 3/2010 Niihara et al.

FOREIGN PATENT DOCUMENTS

| | | |
|---|---|---|
| JP | 64-43430 | 2/1989 |
| JP | 9-58897 | 3/1997 |
| JP | 3690182 | 6/2005 |
| JP | 2010-94870 | 4/2010 |

* cited by examiner

*Primary Examiner* — Michael McCullough
(74) *Attorney, Agent, or Firm* — Cooper & Dunham LLP

(57) ABSTRACT

A sheet conveyance device includes a support unit that supports a sheet; plural suction ports placed on the support unit; a suction unit that suctions the sheet toward the support unit, the suction unit being connected to the plural suction ports; plural valve systems, each valve system being placed between the corresponding suction port and the suction unit, each valve system being openable and closeable; plural valve interlocked suction ports that are to be covered by the sheet when the sheet is conveyed, the plural valve interlocked suction ports being arranged separately from the plural suction ports; and plural opening and closing units that open and close the plural valve systems, each opening and closing unit being placed between one of the valve interlocked suction ports and one of the valve systems.

12 Claims, 6 Drawing Sheets

CONVEYANCE DEVICE AND IMAGE FORMING DEVICE

BACKGROUND OF THE INVENTION

1. Field of the Invention

Embodiments of the present invention relate to a recording device which forms an image on a sheet. Specifically, the embodiments of the present invention relate to a conveyance device having a suction conveyance unit that suctions and conveys various sizes of sheets of materials, which are recording media, using airflows.

2. Description of the Related Art

In a conveyance device used for an image forming device, such as a conventional inkjet printer, when an image is formed, it may be necessary to maintain a constant spacing between a recording unit and a recording medium. Thus, it is not possible to convey the recording medium while holding the recording medium. Therefore, when the recording medium is conveyed, it may be necessary that a deformation or a lifting of the recording medium is regulated. Further, during an image forming process, when a deformation of the recording medium itself occurs, for example, when stretching of the recording medium associated with adhesion of ink (hereinafter, referred to as stretching) or deformation of the recording medium associated with application of heat occurs, it may be necessary to provide a groove portion so that the deformation of the recording medium is released to the opposite side of the recording unit. As described above, the following conveyance device is known. Namely, as shown in FIG. 8, the conveyance device supports the reverse side of the recording medium on a conveyance surface in an image forming area. Further, the conveyance device includes plural suction ports for suctioning the recording medium from the reverse side, so as to prevent the recording medium from being lifted. The conveyance device conveys the recording medium while suctioning the recording medium in the image forming area.

In the above described conveyance device, when the recording medium is conveyed to a position where the recording medium covers all the suction ports 22 of orifices 14, which are arranged on the conveyance surface, since inside of each orifice 14 is sealed, a negative pressure increases and the suction force increases. In this manner, a deformation of the recording medium which exists prior to forming an image or a deformation of a recording medium caused by adhered ink when forming the image is suppressed, and the recording medium can be stably conveyed. Further, since the orifice 14 has a constant length, when a deformation, such as the stretching, occurs on the recording medium, an amount of the deformation can be released to the reverse side of the recording unit by the suction force.

However, at a position shown in FIG. 9, where the recording medium only covers suction ports 22 placed at a front tip or a rear tip of the orifice 14, the air is suctioned through suction ports 22 which are released. Thus, there is a problem that a lifting or a deformation of the recording medium is not sufficiently regulated, since the negative pressure inside the orifice 14 does not increase and the suction force does not increase. Therefore, techniques for controlling a suction force acting onto the recording medium or a suction timing to suction the recording medium in the above described conveyance device are disclosed, for example, in Patent Document 1 (Japanese Published Unexamined Publication No. S64-43430), Patent Document 2 (Japanese Published Unexamined Publication No. H09-058897), and Patent Document 3 (Japanese Registered Patent No. 3690182).

Patent Document 1 discloses a technique such that, when a sheet covers suction ports, an output of a pump is reduced so as to prevent a suction force from becoming rapidly large. However, in this configuration, the air is always suctioned through suction ports other than the suction ports conveying the sheet. In such a case, it may be necessary to adjust the suction force of the pump, so that the sheet is surely conveyed, even if the sheet does not cover all the suction ports. Thus a large pump tends to be used. Therefore, the configuration disclosed in Patent Document 1 has problems that the device becomes large, and noise and cost increase.

Patent Document 2 discloses a technique for avoiding unnecessary suctioning. In the technique, for the suction ports other than the suction ports conveying the sheet, a driving means for opening and closing a valve system and a sensor are used, so as to selectively avoid unnecessary suctioning. With this configuration, the size of the pump can be reduced. However, for example, when a surface for suctioning the sheet is large, in order to selectively avoid unnecessary suctioning at finer areas so as to prevent tips of the sheet from lifting, it may be necessary to place plural driving units for opening and closing the valve system. This leads to complication of the device and growth in size of the device. Further it can be a cause of a cost increase.

Patent Document 3 discloses a technique using a pressure adjustment valve. Namely, when a sheet covers a suction port, the pressure adjustment valve causes a suction force to be generated, and when the sheet does not cover the suction port, the pressure adjustment valve does not allow unnecessary suctioning to be performed. However, in this technique, a suction force is not obtained until the sheet completely covers an orifice (a suction port). Thus, the suction force at the tip of the sheet is always weaker than the suction force at the center of the sheet. Therefore, there is a problem that the technique does not handle the lifting of the tips of the sheet. Further, in this technique, the pressure adjustment valve is closed by fluid flow (wind). However, when the pressure adjustment valve is closed, the fluid does not flow, and the pressure adjustment valve is opened. Patent Document 3 does not disclose a technique to overcome this problem. However, as a technique to overcome this problem, a method in which the valve unit is not completely closed and the valve unit partially leaks the fluid, or a method of completely closing the pressure adjustment valve by a pressure difference between a suction side and an orifice side, the pressure adjustment valve being pinched between the suction side and the orifice side, can be considered. However, when the pressure adjustment valve is not completely closed, since not all the unnecessary suctioning is stopped, inefficiency of the suctioning remains. Further, in the method of completely closing the pressure adjustment valve by the pressure difference between the suction side and the orifice side, at an instant when the recording medium covers the orifice, the pressure difference for closing the pressure adjustment valve is not released, and the pressure adjustment valve is not opened. When the pressure inside the orifice is increased by leakage through a gap between the orifice and the recording medium, the pressure adjustment valve is opened. Therefore, the problem that the technique does not handle the lifting of the tips of the sheet remains. Further, in order to cause the pressure adjustment valve to be opened when a sheet covers a portion of an orifice, a valve may be opened and closed in response to a very small pressure difference or a very small flow difference of a fluid. Therefore, a highly precise valve system may be required, and a suction force from a suction mechanism may be very precise.

Such a technique is not realistic, and it leads to problems, such as a cost increase, degradation of proccessability, and growth in size of the device.

SUMMARY OF THE INVENTION

In one aspect, there is provided a sheet conveyance device including a support unit that supports a sheet; plural suction ports placed on the support unit; a suction unit that suctions the sheet toward the support unit, the suction unit being connected to the plural suction ports; plural valve systems, each valve system being placed between the corresponding suction port and the suction unit, each valve system being openable and closeable; plural valve interlocked suction ports that are to be covered by the sheet when the sheet is conveyed, the plural valve interlocked suction ports being arranged separately from the plural suction ports; and plural opening and closing units that open and close the plural valve systems, each opening and closing unit being placed between one of the valve interlocked suction ports and one of the valve systems.

In another aspect, there is provided an image forming device including a sheet conveyance device. The sheet conveyance device includes a support unit that supports a sheet; plural suction ports placed on the support unit; a suction unit that suctions the sheet toward the support unit, the suction unit being connected to the plural suction ports; plural valve systems, each valve system being placed between the corresponding suction port and the suction unit, each valve system being openable and closeable; plural valve interlocked suction ports that are to be covered by the sheet when the sheet is conveyed, the plural valve interlocked suction ports being arranged separately from the plural suction ports; and plural opening and closing units that open and close the plural valve systems, each opening and closing unit being placed between one of the valve interlocked suction ports and one of the valve systems.

Other objects, features and advantages of the present invention will become more apparent from the following detailed description when read in conjunction with the accompanying drawings.

DETAILED DESCRIPTION OF THE PREFERRED EMBODIMENTS

It is an objective of embodiments of the present invention to solve the above described problems. Further, it is an objective of the embodiments of the present invention to provide a conveyance device that can suction a sheet immediately before the sheet covers a suction port, that can keep suctioning the sheet until the sheet is completely separated from the suction port, that can surely prevent the sheet from lifting, and that can perform efficient and stable sheet conveyance, without additionally arranging a sensor or an actuator.

Figure 1:
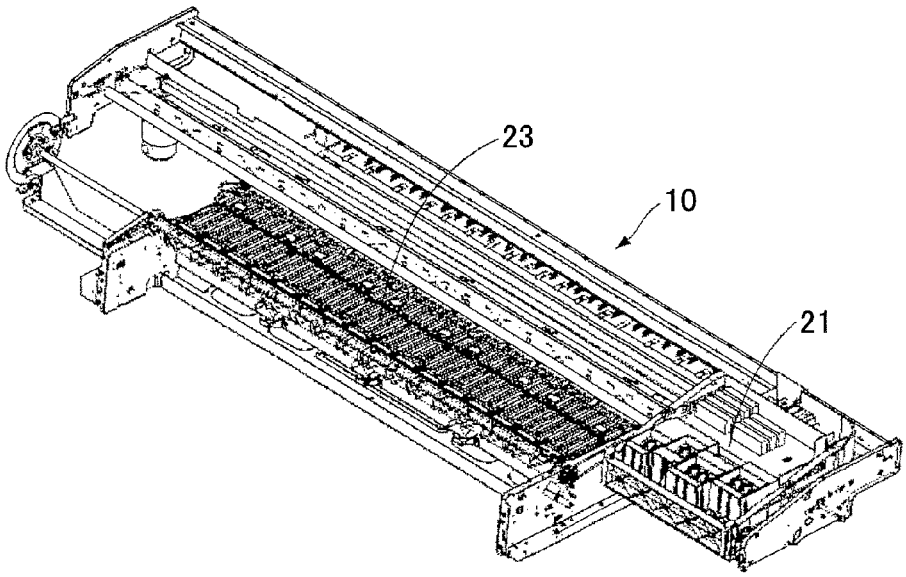
FIG. 1 is a schematic diagram of a major portion of an inkjet recording device, to which an embodiment of the present invention can be applied.
Figure 2:
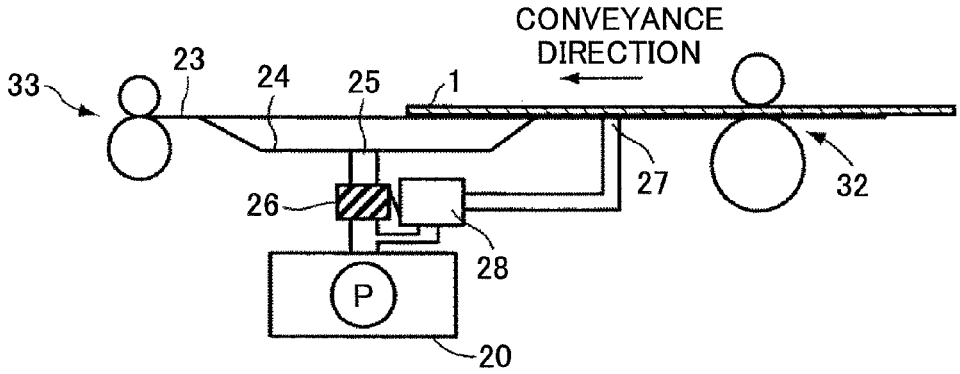
FIG. 2 is a schematic diagram of a conveyance device used in a first embodiment of the present invention.

FIG. 1 is a schematic diagram of an inkjet recording device 10, which is an image forming device to which an embodiment of the present invention can be applied. The inkjet recording device 10 includes a carriage 21 which can reciprocate in a main scanning direction. Here, the main scanning direction is a width direction of a recording paper, and the main scanning direction is perpendicular to a conveyance direction of the recording paper. The carriage 21 includes a recording head (not shown in the figure) which discharges black ink, magenta ink, cyan ink, and yellow ink. A guide plate 23 is placed at upstream side of the carriage 21 in the conveyance direction of the recording paper. The guide plate 23 serves as a supporting unit. On an upper surface of the guide plate 23, a recording paper is conveyed. As shown in FIG. 2, plural orifices 24 are formed on the guide plate 23. The plural orifices 24 are formed in a conveyance direction of a sheet 1 and in a width direction of the sheet 1. Here, the sheet 1 is conveyed on the guide plate 23. A suction port 25 is formed inside each orifice 24. The suction port 25 is connected to a suction unit 20 which incorporates a pump. Further, an openable and closeable valve system 26 is placed between the suction port 25 and the suction unit 20.

Figure 3:
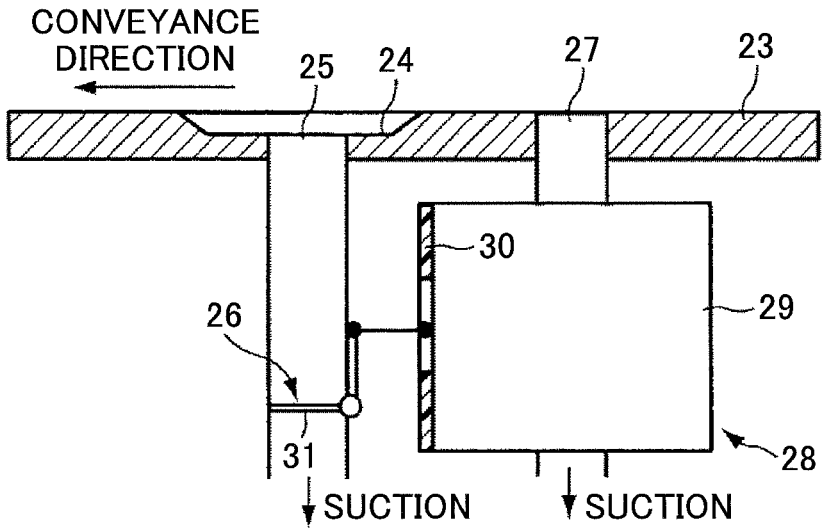
FIG. 3 is a schematic diagram illustrating an opening and closing unit used in the first embodiment of the present invention.

A valve interlocked suction port 27 is placed at upstream side of the corresponding suction port 25 on the guide plate 23 in the conveyance direction of the sheet 1. The valve interlocked suction port 27 is connected to the suction unit 20. In the channel connecting the valve interlocked suction port 27 and the suction unit 20, an opening and closing unit 28 for opening and closing the valve system 26 is placed. As shown in FIG. 3, the opening and closing unit 28 includes a flexible member 30 which is arranged in an air chamber 29. The flexible member 30 is placed at one side of the air chamber 29. The flexible member 30 is connected to one end of an on-off valve 31, which is included in the valve system 26. The valve system 26 includes the L shaped on-off valve 31. A bent portion of the on-off valve 31 is rotatably attached to a wall portion of a flow channel connected to the suction unit 20. Further, a pair of conveyance rollers 32 for conveying the sheet 1 is placed at upstream side of the valve interlocked suction port 27 in the conveyance direction of the sheet 1. Additionally, a pair of conveyance rollers 33 for conveying the sheet 1 is placed at downstream side of the orifice 24 in the conveyance direction of the sheet 1.

Figure 4:
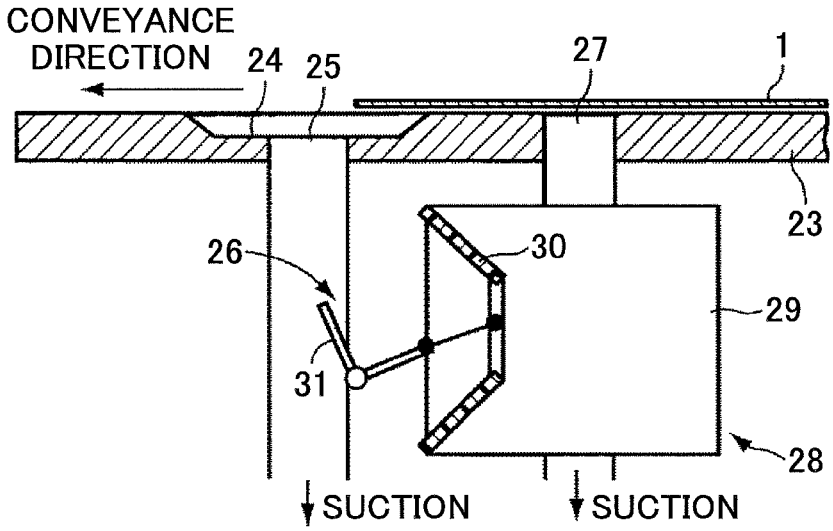
FIG. 4 is a schematic diagram illustrating the opening and closing unit used in the first embodiment of the present invention.

With the above described configuration, in a state shown in FIG. 3 in which the sheet 1 has not reached the valve interlocked suction port 27, since the on-off valve 31 blocks the flow channel, a suction force does not act at the suction port 25, even if the suction unit 20 is working. In this case, the suction force only acts at the valve interlocked suction port 27. When the valve interlocked suction port 27 is blocked by the conveyed sheet 1 as shown in FIG. 4, the pressure inside the air chamber 29 becomes a negative pressure by the operation of the suction unit 20. Thus the flexible member 30 is deformed. With the deformation of the flexible member 30, the on-off valve 31 connected to the flexible member 30 rotates and the flow channel is released. Then the suction force from the suction unit 20 also acts at the suction port 25.

In the above described embodiment 1, the air is suctioned prior to the front tip of the sheet 1 reaching the orifice 24. When the front tip of the sheet 1 reaches the orifice 24, a sufficient suction force from the suction unit 20 is acting. Therefore, by using a lower cost configuration in which sensors or electrical driving mechanisms are not used, the sheet 1 can be stably conveyed while the lifting of the front tip of the sheet 1 is prevented. Further, plural of the suction ports 25 and plural of the valve interlocked suction ports 27 are arranged in the width direction of the sheet 1. Therefore, when a sheet having a different width is conveyed, an unnecessary suction is not performed, and the sheet can be stably conveyed while the lifting of the sheet is prevented. Further, since the valve interlocked suction port 27 is placed at upstream side of the suction port 25 in the sheet conveyance direction, it is ensured that the front tip of the sheet 1 is suctioned first. Therefore, the sheet 1 can be stably conveyed while the lifting of the tip of the sheet 1 is surely prevented. Further, since the plural suction ports 25 are also arranged in the sheet conveyance direction, an unnecessary suction is not performed when an image is formed over a long distance in the sheet conveyance direction. Therefore, the sheet 1 can be stably conveyed while the lifting of the tip of the sheet 1 is prevented. Further, when a pressure difference between the atmospheric pressure and the pressure inside the valve interlocked suction port 27 is greater than a predetermined value, the opening and closing unit 28 opens the on-off valve 31. Therefore, the valve system 26 can be opened and closed more reliably.

In the embodiment, the valve interlocked suction port 27 is arranged at downstream side of the pair of conveyance rollers 32 in the sheet conveyance direction. However, the position of the valve interlocked suction port 27 is not limited to this. It is preferable that the valve interlocked suction port 27 be arranged at a suitable position depending on a conveyance speed of the sheet 1, or a layout of the inkjet recording device 10. Further, in the configuration of the embodiment, the flexible member 30 is used in the opening and closing unit 28. However, a piston mechanism can be used instead of the flexible member 30.

Figure 5:
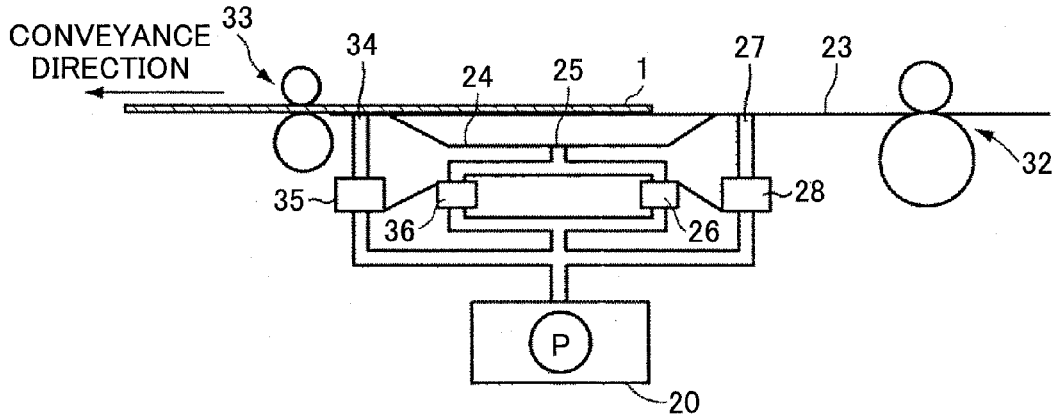
FIG. 5 is a schematic diagram of a conveyance device used in a second embodiment of the present invention.

FIG. 5 shows a second embodiment of the present invention. Compared to the first embodiment, the second embodiment is different from the first embodiment in the following points. A valve interlocked suction port 34 is arranged at downstream side of the orifice 24 in the sheet conveyance direction. At the same time, in a flow channel connecting the valve interlocked suction port 34 and the suction unit 20, an opening and closing unit 35 similar to the opening and closing unit 28 is arranged. The flow channel connecting the suction port 25 and the suction unit 20 is divided into two flow channels. The valve system 26 is arranged in the first flow channel, and the valve system 36 similar to the valve system 26 is arranged in the second flow channel. The valve system 26 is opened and closed by the opening and closing unit 28, and the valve system 36 is opened and closed by the opening and closing unit 35.

With the above described configuration, in addition to the effect of the first embodiment, the following effects can be obtained. Namely, in the state shown in FIG. 5 in which the end tip of the sheet 1 is not completely covering the orifice 24, since the sheet 1 is covering the valve interlocked suction port 34, the suction force from the suction unit is acting at the suction port 25. Therefore, the air is suctioned from the suction port 25 after the end tip of the sheet 1 has passed through the upstream end portion of the orifice 24. Therefore, by using a low cost configuration in which sensors or electrical driving mechanisms are not used, the sheet 1 can be stably conveyed while the lifting of the end tip of the sheet 1 is prevented. Further, with such a configuration, an unnecessary suction that might be performed after the end tip of the sheet 1 is completely separated from the orifice 24 can be avoided.

Figure 6:
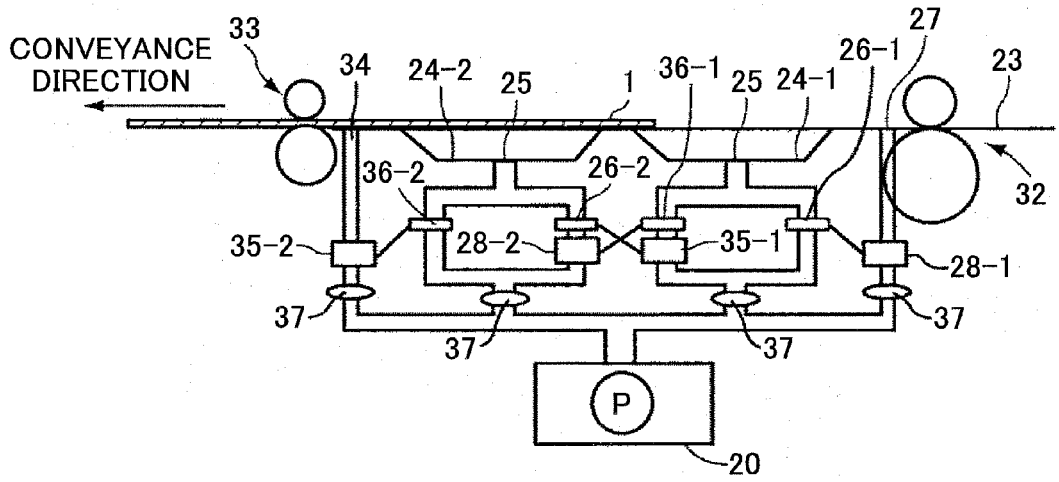
FIG. 6 is a schematic diagram of a conveyance device used in a third embodiment of the present invention.

FIG. 6 shows a third embodiment of the present invention. In the third embodiment, plural orifices 24 are arranged in the sheet conveyance direction. The valve interlocked suction port 27 is arranged at upstream side of an orifice 24-1 in the sheet conveyance direction. Here, the orifice 24-1 is arranged at the upstream most position among the plural orifices. A valve mechanism 26-1 arranged in a first flow channel of first divided flow channels is opened and closed by an opening and closing unit 28-1 which is arranged between the valve interlocked suction port 27 and the suction unit 20. The valve interlocked suction port 34 is arranged at downstream side of an orifice 24-2 in the sheet conveyance direction. Here, the orifice 24-2 is arranged at the downstream most position among the plural orifices. A valve mechanism 36-2 arranged in a second flow channel of second divided flow channels is opened and closed by an opening and closing unit 35-2 which is arranged between the valve interlocked suction port 34 and the suction unit 20. At a position where the orifices 24-1 and 24-2 are neighboring each other, an opening and closing unit 35-1 arranged in the second flow channel of the first divided flow channels of the upstream side orifice 24-1 opens and closes a valve mechanism 26-2 arranged in the first flow channel of the second divided flow channels of the downstream side orifice 24-2. Further, an opening and closing unit 28-2 arranged in the first flow channel of the second divided flow channels of the downstream side orifice 24-2 opens and closes a valve mechanism 36-1 arranged in the second flow channel of the first divided flow channels of the upstream side orifice 24-1. Further, check valves 37 are arranged at a downstream position of the opening and closing unit 28-1, a downstream position of a position at which the first divided flow channels of the upstream side orifice 24-1 meet, a downstream position of a position at which the second divided flow channels of the downstream side orifice 24-2 meet, and a downstream position of the opening and closing unit 35-2, respectively.

With the above described configuration, when plural orifices are densely arranged, a valve system arranged in a first orifice can be opened and closed by a pressure difference between the atmospheric pressure and the pressure in a second orifice, which is neighboring to the first orifice, without introducing a new valve interlocked suction port. Therefore, a stable conveyance can be realized without cost increase. Further, since check valves are provided, even if the suction ports 25 neighboring to each other are opened, the valve mechanisms 26, 35 can be surely operated.

Figure 7:
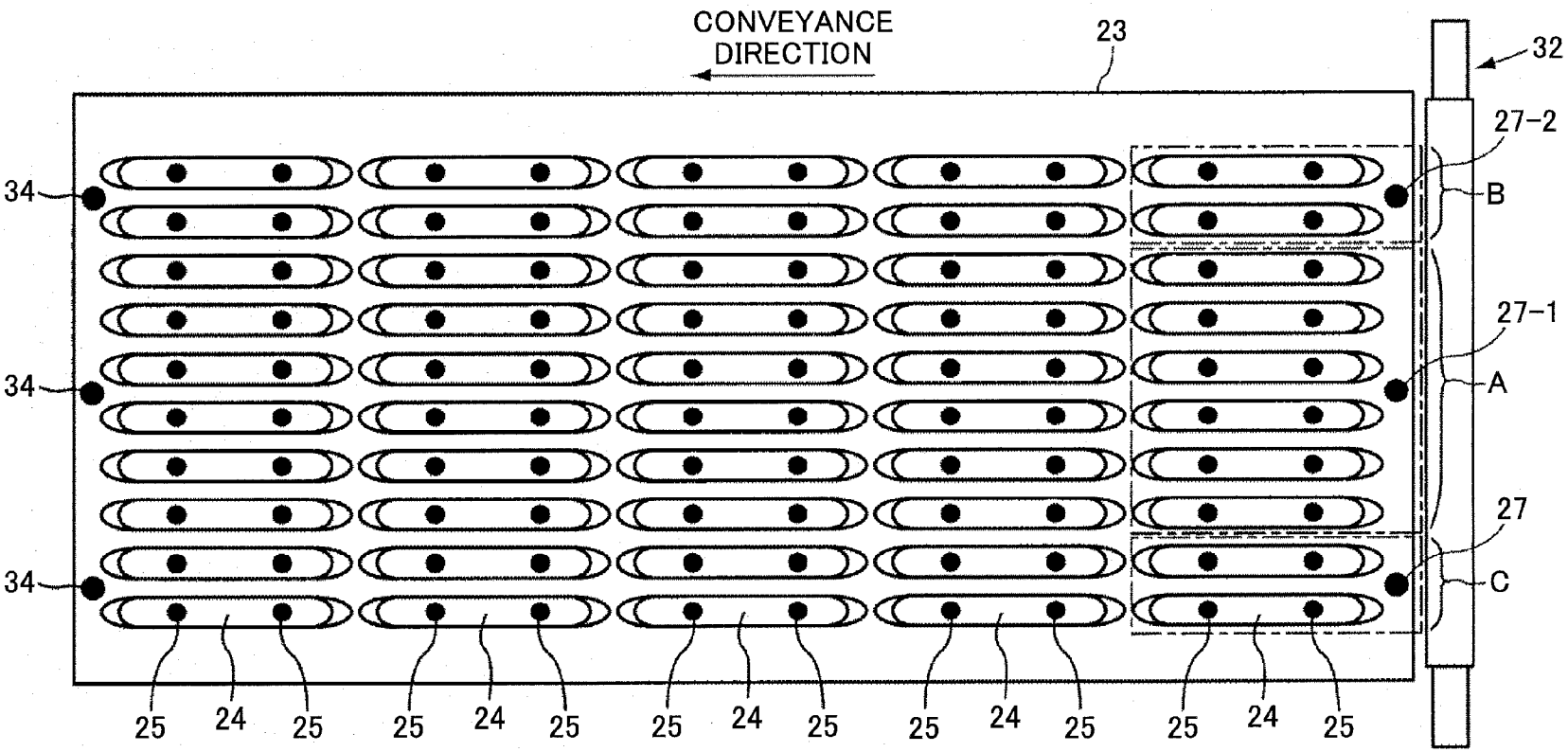
FIG. 7 is a schematic diagram of a conveyance device used in a fourth embodiment of the present invention.
Figure 8:
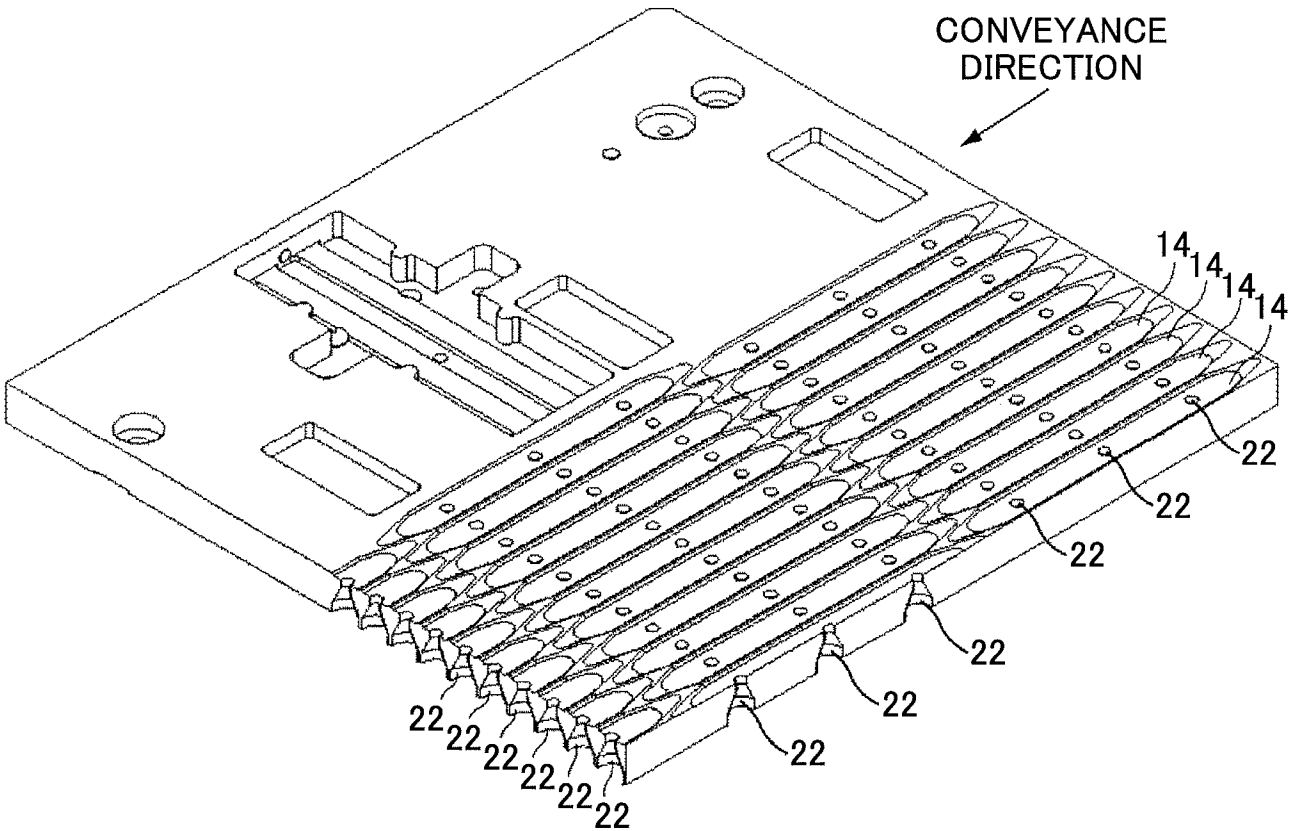
FIG.8 RELATED ART
FIG. 8 is a schematic diagram illustrating a problem.
Figure 9:
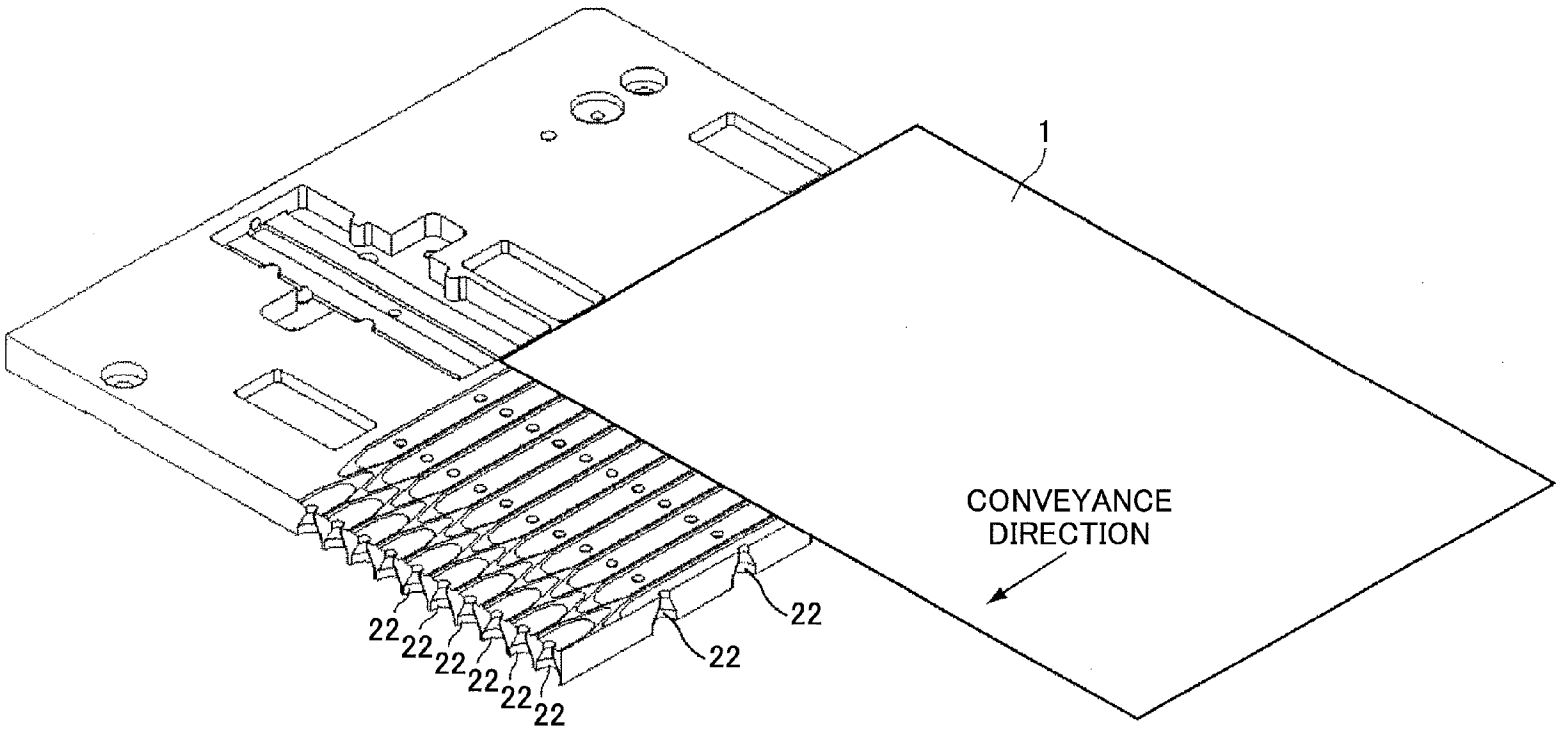
FIG.9 RELATED ART
FIG. 9 is a schematic diagram illustrating the problem.

FIG. 7 shows a fourth embodiment of the present invention. In this embodiment, one valve interlocked suction port 27 is placed for plural suction ports 25. Specifically, for the plural suction ports 25 included in an area A of central six rows, a valve interlocked suction port 27-1 is arranged. For the plural suction ports 25 included in an area B of upper two rows, a valve interlocked suction port 27-2 is arranged. Further, for the plural suction ports 25 included in an area C of lower two rows, a valve interlocked suction port 27 is arranged. When the valve interlocked suction port 27-1 is covered with the sheet 1, the suction ports 25 included in the area A start suctioning. When the valve interlocked suction port 27-2 is covered with the sheet 1, the suction ports 25 included in the area B start suctioning. Further, when the valve interlocked suction port 27 is covered with the sheet 1, the suction ports 25 included in the area C start suctioning.

In the above configuration, when types of the sheet 1 are limited to several types, and, for example, when the sheet 1 is conveyed while the sheet 1 is aligned to the central portion, the width of the area A may be adjusted to be a width of the smallest type of the sheet 1 to be conveyed. Further, it is not necessary that a valve interlocked suction port 27 be placed for each suction port 25. With the above configuration, cost reduction may be achieved. Additionally, the above configuration is advantageous as a layout of the inkjet recording device 10.

With the configurations shown in the embodiments, when plural sheets 1 are conveyed while the sheets 1 are evenly spaced apart in the conveyance direction or in the width direction, it is possible to cause the suction ports 25, above which the sheets 1 do not exist, not to suction, and cause the only suction ports 25, to which the sheets 1 are to be conveyed immediately after, to suction. Therefore, recording papers are efficiently suctioned, and the recording papers can be stably conveyed. Further, when an image is formed by a single scanning across the spacing of the sheets (for example, when the sheets are conveyed while the sheets are evenly spaced apart in the conveyance direction, a case in which an image is formed by a single scanning of a rear end portion of the front sheet and a front end portion of the successive sheet), an occurrence of an air current caused by the suction can be minimized by eliminating redundant suction operations, which are the suction operations between the sheets. In this case, adverse effects on ink discharge caused by the occurrence of the air current can be reduced.

The present invention is not limited to the specifically disclosed embodiments, and variations and modifications may be made without departing from the scope of the present invention.

The present application is based on Japanese Priority Application No. 2011-011092, filed on Jan. 21, 2011, the entire contents of which are hereby incorporated herein by reference.

What is claimed is:

1. A sheet conveyance device comprising:

a support unit that supports a sheet;

plural suction ports placed on the support unit;

a suction unit configured to suction the sheet toward the support unit, the suction unit being connected to the plural suction ports through corresponding first channels;

plural valve systems, each of the valve systems being disposed in the corresponding first channel connecting the corresponding suction port and the suction unit, each of the valve systems being openable and closable;

plural valve interlocked suction ports that are to be covered by the sheet when the sheet is conveyed, the plural valve interlocked suction ports being arranged separately from the corresponding suction ports; and plural opening and closing units configured to open and close the corresponding valve systems, each of the opening and closing units being placed between one of the valve interlocked suction ports and one of the corresponding valve systems, wherein the suction unit is connected to the plural valve interlocked suction ports through corresponding second channels, wherein the first channels are different from the corresponding second channels and wherein the opening and closing units are disposed in the corresponding second channels.

2. The sheet conveyance device according to claim 1, wherein the plural suction ports and the plural valve interlocked suction ports are arranged in a width direction of the sheet.

3. The sheet conveyance device according to claim 1, wherein the plural valve interlocked suction ports are arranged at an upstream side of the corresponding suction ports in a sheet conveyance direction.

4. The sheet conveyance device according to claim 1, wherein the plural suction ports are connected to the suction unit through corresponding fluid channels, and each of the valve systems is placed on the corresponding fluid channel, and wherein the plural valve interlocked suction ports are arranged at an upstream side and a downstream side of the plural suction ports in a sheet conveyance direction.

5. The sheet conveyance device according to claim 1, wherein the plural suction ports are arranged in a sheet conveyance direction.

6. The sheet conveyance device according to claim 1, wherein each of the valve interlocked suction ports is associated with a corresponding portion of the plural suction ports.

7. The sheet conveyance device according to claim 1, wherein each of the opening and closing units is configured to open the corresponding valve system, when a pressure difference between an atmospheric pressure and a pressure inside the corresponding valve interlocked suction port is greater than or equal to a constant value.

8. The sheet conveyance device according to claim 1, wherein a check valve is arranged between each of the opening and closing units and the suction unit.

9. The sheet conveyance device according to claim 1, wherein each of the opening and closing units includes a flexible member, and wherein each of the valve systems is opened when the sheet covers the corresponding suction port and the corresponding flexible member is deformed.

10. The sheet conveyance device according to claim 1, wherein the sheet conveyance device conveys plural of the sheets while the plural sheets are evenly spaced apart in a conveyance direction in which the plural sheets are conveyed or a width direction perpendicular to the conveyance direction.

11. An image forming device comprising:

a sheet conveyance device, wherein the sheet conveyance device includes a support unit that supports a sheet;

plural suction ports placed on the support unit;

a suction unit configured to suction the sheet toward the support unit, the suction unit being connected to the plural suction ports through corresponding first channels;

plural valve systems, each of the valve systems being disposed in the corresponding first channel connecting the corresponding suction port and the suction unit, each of the valve systems being openable and closable;

plural valve interlocked suction ports that are to be covered by the sheet when the sheet is conveyed, the plural valve interlocked suction ports being arranged separately from the corresponding suction ports; and plural opening and closing units configured to open and close the corresponding valve systems, each of the opening and closing units being placed between one of the valve interlocked suction ports and one of the corresponding valve systems, wherein the suction unit is connected to the plural valve interlocked suction ports through corresponding second channels, wherein the first channels are different from the corresponding second channels, and wherein the opening and closing units are disposed in the corresponding second channels.

12. A sheet conveyance device comprising:

a support unit that supports a sheet;

plural suction ports placed on the support unit;

a suction unit configured to suction the sheet toward the support unit, the suction unit being connected to the plural suction ports through corresponding first channels;

plural valve systems, each of the valve systems being disposed in the corresponding first channel connecting the corresponding suction port and the suction unit, each of the valve systems being openable and closable;

plural valve interlocked suction ports that are to be covered by the sheet when the sheet is conveyed, the plural valve interlocked suction ports being arranged separately from the corresponding suction ports; and plural opening and closing units configured to open and close the corresponding valve systems, wherein the suction unit is connected to the plural valve interlocked suction ports through corresponding second channels, wherein the first channels are different from the corresponding second channels, and wherein the opening and closing units are disposed in the corresponding second channels.

* * * * *